United States Patent [19]

Liu

[11] 4,085,063

[45] Apr. 18, 1978

[54] NON-CHROMATE PITTING AND GENERAL CORROSION INHIBITORS FOR ALUMINUM PRODUCTS AND METHOD

[75] Inventor: Chia-tsun Liu, Monroeville, Pa.

[73] Assignee: Westinghouse Electric Corporation, Pittsburgh, Pa.

[21] Appl. No.: 773,876

[22] Filed: Mar. 3, 1977

Related U.S. Application Data

[63] Continuation-in-part of Ser. No. 730,060, Oct. 6, 1976, abandoned.

[51] Int. Cl.[2] ..... C23F 11/08; C09K 3/00

[52] U.S. Cl. ..... 252/387; 21/2.7 R

[58] Field of Search ..... 21/2.7 R; 252/387

[56] References Cited

U.S. PATENT DOCUMENTS

| | | | |
|---|---|---|---|
| 2,153,952 | 4/1939 | Bayes | 252/387 X |
| 2,348,678 | 5/1944 | George | 21/2.7 R UX |
| 2,560,839 | 7/1951 | Ayo et al. | 21/2.7 R UX |
| 3,340,001 | 9/1967 | Thornhill | 21/2.7 R |
| 3,630,752 | 12/1971 | Scott | 21/2.7 R X |
| 3,655,582 | 4/1972 | Dupre et al. | 21/2.7 R X |
| 3,711,246 | 1/1973 | Foroulis | 21/2.7 R |
| 3,948,792 | 4/1976 | Watsën et al. | 21/2.7 R X |

FOREIGN PATENT DOCUMENTS

| | | | |
|---|---|---|---|
| 691,578 | 5/1953 | United Kingdom | 21/2.7 R |

*Primary Examiner*—Barry S. Richman
*Attorney, Agent, or Firm*—R. S. Lombard

[57] ABSTRACT

A method for inhibiting pitting and corrosion and a pitting and general corrosion inhibitor for a water-cooled system which includes aluminum water-cooled members which have water-carrying channels formed therein and including other metal or metals. The pitting and general corrosion inhibitor is a mixture of water-soluble nitrate and water-soluble metasilicate, the combination of which exhibits a pronounced synergistic effect in providing excellent pitting and general corrosion resistance for aluminum exposed to aqueous environments.

11 Claims, 1 Drawing Figure

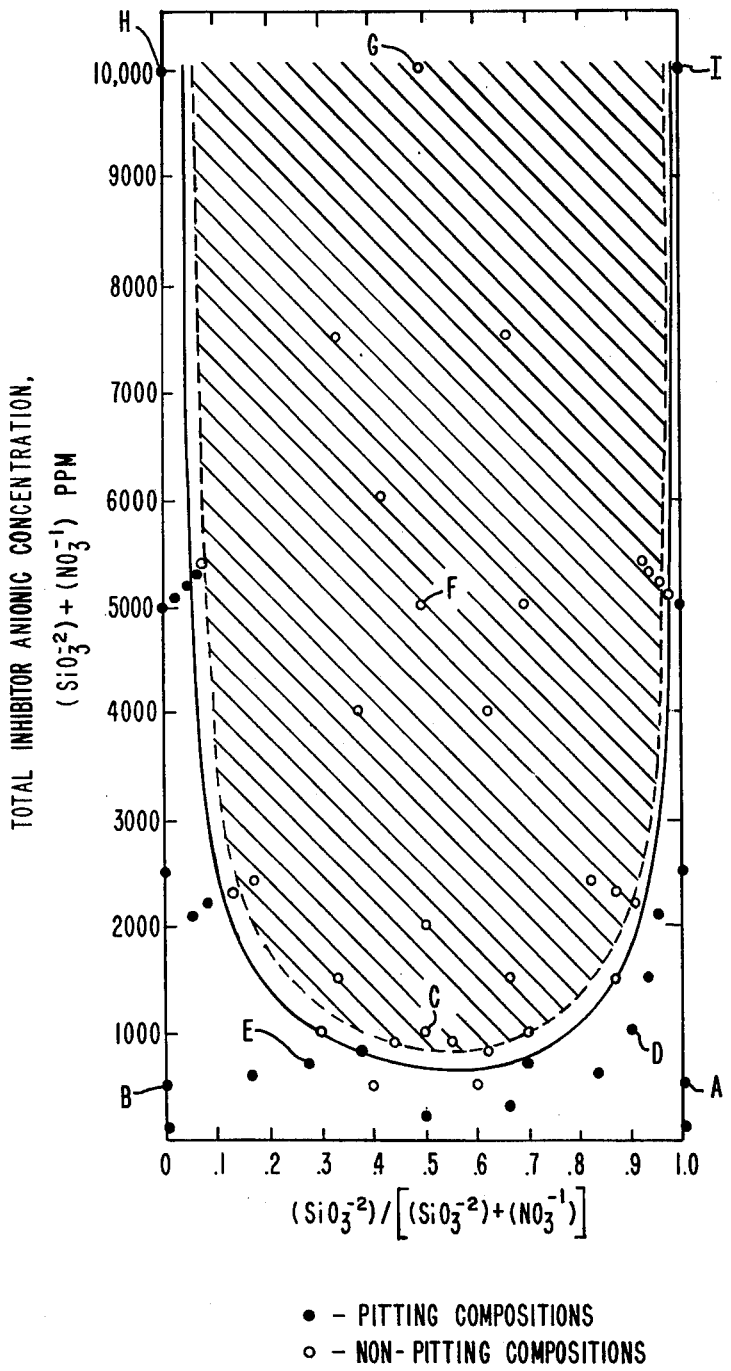
H
G
I
10,000
9000
8000
7000
6000
5000
4000
3000
2000
1000
F
C
E
D
B
A
TOTAL INHIBITOR ANIONIC CONCENTRATION,
$(SiO_3^{-2}) + (NO_3^{-1})$ PPM
0 .1 .2 .3 .4 .5 .6 .7 .8 .9 1.0
$(SiO_3^{-2}) / [(SiO_3^{-2}) + (NO_3^{-1})]$
● - PITTING COMPOSITIONS
○ - NON-PITTING COMPOSITIONS

NON-CHROMATE PITTING AND GENERAL CORROSION INHIBITORS FOR ALUMINUM PRODUCTS AND METHOD

This application is a continuation-in-part of application Ser. No. 730,060 filed Oct. 6, 1976, now abandoned, and owned by the present assignee.

BACKGROUND OF THE INVENTION

This invention relates to a method and inhibitor to prevent pitting and general corrosion in aluminum products exposed to aqueous environments, without the use of chromates. Chromate and dichromate salts have been extensively used in the past as corrosion inhibitors for aluminum alloys in aqueous environments. Although these inhibitors are effective, the chromate ion is reported to be toxic and subject to adverse safety and pollution control regulations.

There have been many non-chromate inhibitors developed over the years. In U.S. Pat. No. 2,560,839 dated July 17, 1951, to Ayo et al. is disclosed a corrosion inhibitor for use in conjunction with a detergent for a mechanical washing operation. The corrosion inhibitor prevents the detergent from attacking and tarnishing the metal parts of a washing machine. This patent discloses that about 1 to about 5% by weight of silicates, particularly metasilicate, have been found to be an effective corrosion inhibitor.

In U.S. Pat. No. 3,340,001 dated Sept. 5, 1967 to Thornhill is disclosed a corrosion inhibitor for water used as a cooling medium to protect metals in contact with the water from corrosion thereby. The inhibitor comprises urea, alkali metal cyanate, minor constituents of sodium mercaptobenzthiazole, benztriazole, alkali metal nitrate, alkali metal nitrite, and alkali metal silicate excepting metasilicate.

In U.S. Pat. No. 3,948,792 dated Apr. 6, 1976, to Watsen et al. is disclosed a silicate containing anticorrosion formula for use in automobile and diesel coolant systems. A formula is used which comprises the addition of polymeric dispersants to a silicate containing corrosion inhibitor such as the boron-nitrite type ameliorates.

In British Pat. No. 691,578 published May 13, 1953, is disclosed a corrosion inhibitor for aluminum, aluminum-manganese having a concentration of from 2 to 20% per volume of water and containing a mixture of sodium carbonate and urea and minor constituents of sodium nitrate and sodium silicate.

The prior art in general discloses corrosion inhibitors for use in substantially open loop coolant systems having a relatively short use cycle, such as automotive radiators. For short use purposes high concentrations, i.e., greater than 1%, of inhibitor may be desirable. This has been found not to be the case when an inhibitor is used to prevent corrosion and pitting in a closed-loop system designed for very long term operation, such as a water-cooled fluorescent lighting installation. In such an installation concentrations greater than 1% of inhibitor permit rapid corrosion.

SUMMARY OF THE INVENTION

There is provided an effective pitting and general corrosion inhibitor and a method for inhibiting pitting and general corrosion for a water-cooled system which includes aluminum water-cooled members which have water-carrying channels formed therein which may have residual amounts of titanium oxide enclosed and retained in the formed channels. The pitting and general corrosion inhibitor consists essentially of a mixture of water-soluble metasilicate and water-soluble nitrate. The total anionic concentration of the mixture is from about 750 ppm to about 10,000 ppm taken with respect to the water. The effective concentration of the metasilicate ions and nitrate ions are such that the total anionic concentration of inhibitor ions vs. the ionic ratio of:

$$\frac{(SiO_3^{-2})}{(SiO_3^{-2}) + (NO_3^{-1})}$$

falls within the cross-hatched area in the graph as shown in the sole FIGURE of the drawing. The cross-hatched area shows the non-pitting region for the mixture.

In more complicated mixing metal systems, the ratio of the metasilicate ion concentration (ppm) to the total inhibitor anion concentration (ppm), as plotted on the abscissa of the graph, must be further limited. For example:

(1) in a system where carbon steel has been added, the foregoing ratio as plotted on the abscissa must be greater than 0.5 to prevent corrosion; (2) in a system containing copper, carbon steel, and stainless steel the ratio must be greater than 0.7 to prevent crevice-type corrosion.

BRIEF DESCRIPTION OF THE DRAWING

For a better understanding of the invention, reference may be had to the exemplary embodiment shown in the accompanying drawing in which the sole FIGURE is a graph of total anionic concentration of the inhibitor ions vs. the ionic ratio of:

$$\frac{(SiO_3^{-2})}{(SiO_3^{-2}) + (NO_3^{-1})}$$

in which the cross-hatched area illustrates the non-pitting region for the mixture of metasilicate-nitrate aluminum corrosion inhibitor. The blackened or solid data points indicate pitting compositions and the unblackened or hollow data points indicate non-pitting compositions.

DESCRIPTION OF THE PREFERRED EMBODIMENT

This invention relates to an effective pitting and general corrosion inhibitor for a water-cooled system which includes aluminum water-cooled members which have water-carrying channels formed therein which may have residual amounts of titanium oxide enclosed and retained within the formed channels. An example of such a system are the water-cooled fluorescent lighting panels in general use, fabricated from aluminum with a so-called titanium oxide stopweld. The aluminum panels are fabricated by placing finely divided titanium oxide between two aluminum panels in the configuration desired for the channels and welding of the two panels is effected. Internal pressure is then applied to form the water-carrying channels, and small residual amounts of the titanium oxide remain in the formed channels.

The water flowing through the water-cooled fluorescent lighting panels is typically corrosive water containing impurities such as, 40 ppm $Ca^{++}$, 71 ppm $Cl^{-}$, 23 ppm $Na^+$, 61 ppm $HCO_3^-$, and 0.32 ppm $Cu^{++}$. Without protection, pitting occurs within the channels of the fluorescent lighting panels within a few hours thereby permitting the water containing therein to leak out. In an actual installation this leakage can cause water damage. Even in the presence of single corrosion inhibitors, such as soluble metasilicates, thiourea, molybdates, nitrates, and nitrates, pitting occurs within a few days. The foregoing inhibitors can be added to the corrosive water as a salt having a monovalent alkali-metal such as lithium, potassium, or sodium. Other water-soluble salts, such as, nitrates of calcium, magnesium, and ammonium can be used. Care must be taken to maintain the desired inhibitor concentration when adding the water-soluble salts to the solution to prevent the precipitation of metasilicate. Sodium is the most desirable monovalent alkali-metal. It is the least expensive and the most readily available. In testing the single inhibitor soluble metasilicate, 500 ppm of metasilicate ion, shown as point A on the graph in the sole FIGURE, i.e., 0.8 gram per liter of sodium metasilicate ($Na_2SiO_3$), was added to the corrosive water and pitting occurred in 45 minutes. In testing the single inhibitor soluble nitrate, 500 ppm of nitrate ion, point B in the graph, i.e., 0.68 grams per liter of sodium nitrate ($NaNO_3$) was added to the corrosive water and pitting occurred in a few days.

It has been found that the combination inhibitor containing a mixture of water-soluble metasilicate and water-soluble nitrate with a total anionic concentration of metasilicate plus nitrate being from about 750 ppm to about 10,000 ppm, taken with respect to the water, displays a pronounced synergistic effect and is a good inhibitor against pitting and general corrosion when the effective concentration of metasilicate and nitrate are such that the relationship of the total anionic concentration vs. the ratio of:

$$\frac{(SiO_3^{-2})}{(SiO_3^{-2}) + (NO_3^{-1})}$$

as shown in the graph in the FIGURE falls within the cross-hatched area. The cross-hatched area indicates a nonpitting region for the metasilicate-nitrate aluminum inhibitor. The curve having a dashed line bordering the cross-hatched area indicates the outer boundary of a safe region in which no pitting will occur. The area between the curve having a dashed line and the curve having a solid line indicates a marginal region in which pitting may occur. Outside the curve having a solid line pitting will normally occur. Thus, a relatively wide range of total anionic concentration and anionic concentration ratios of the nitrate and soluble metasilicate mixtures, prevent the water-cooled system from pitting in the corrosive environment hereinbefore described.

For example, point C on the graph indicates a composition of 500 ppm of metasilicate ion (0.8 gram per liter of water) and 500 ppm of nitrate ion (0.68 gram per liter of water); after more than 4 years immersion tests there was no pitting and only very slight corrosion. In contrast to point D in the graph having a composition of 900 ppm of metasilicate ion and 100 ppm of nitrate ion and point E having a concentration of 200 ppm of metasilicate ion and 500 ppm of nitrate ion, pitting occurred in both cases within a month. Thus, at relatively equal total inhibitor concentrations pitting occurred at points on the graph outside of the cross-hatched area, but no pitting occurred within the cross-hatched area, thereby displaying the synergistic effect. As the total inhibitor anionic concentration was increased, increased general corrosion was observed. For example, point F in the graph having a total anionic concentration of 5,000 ppm had noticeably more general corrosion than point C at 1,000 ppm, but point F had less general corrosion than point G in the graph having a concentration of 10,000 ppm. Beyond 10,000 ppm inhibitor concentration the corrosion rate is very rapid making such concentrations undesirable for use as an inhibitor. Although point G showed a good deal of corrosion after a period of months, no pitting occurred, whereas, points H and I having a concentration of 10,000 ppm of nitrate ion, silicate ion respectively, had pitting occur almost immediately. It has been found that small additions of other additives, such as sodium nitrate, can be added to the present corrosion inhibitor without any undesirable effects.

In more complicated mixed metal systems, the ratio of metasilicate concentration (ppm) to the total inhibitor anionic concentration must be altered. For example, in a system where carbon steel has been added, the abscissa ratio as shown in the graph must be greater than 0.5 to prevent carbon steel corrosion. In a system having copper or brass, carbon steel, and stainless steel added, the foregoing ratio must be greater than 0.7 to prevent crevice-type corrosion.

Two long term test loops were tested with a mixed-metal system at a temperature of 98° F. One loop contained de-ionized water, 1000 ppm of metasilicate ion, and 500 ppm of nitrate ion. The other loop contained simulated river water, 1000 ppm of metasilicate ion, and 500 ppm of nitrate ion. Each loop consisted of water-cooled titanium stop-weld aluminum lighting fixtures, tubing of cooper, steel, stainless steel, plastic and aluminum; connectors of aluminum, carbon steel, and stainless steel; and valves of stainless steel and brass. After two years, no pitting occurred. No general corrosion was visually observed, although during the operation a small quantity of hydrogen had been generated. Routine checks on both pH and conductance of the inhibitor solutions indicated that the solution properties had not changed significantly during approximately 2 years of operation.

What is claimed is:

1. An effective pitting and general corrosion inhibitor for a water-cooled system which includes aluminum water-cooled members which have water-bearing channels formed therein, said inhibitor consisting essentially of an aqueous solution of water-soluble metasilicate and water-soluble nitrate, with a total anionic concentration of metasilicate ions plus nitrate ions being from about 750 ppm to about 10,000 ppm taken with respect to the water, with the concentration of said metasilicate ions and said nitrate ions being such that the total anionic concentration of said metasilicate ions versus the ionic ratio of $$\frac{(SiO_3^{-2})}{(SiO_3^{-2}) + (NO_3^{-1})}$$

falls within the cross-hatched area in the graph as shown in the sole FIGURE of the drawing.

2. The pitting and general corrosion inhibitor of claim 1, wherein residual amounts of titanium oxide are enclosed and retained within the formed water-bearing channels.

3. The pitting and general corrosion inhibitor of claim 1, wherein said water-cooled system also includes carbon steel members as water-carrying members and said ionic ratio is at least 0.5.

4. The pitting and general corrosion inhibitor of claim 1, wherein said water-cooled system includes copper or brass, carbon steel, and stainless steel members as water-carrying members, and said ionic ratio is at least 0.7.

5. The pitting and general corrosion inhibitor of claim 1, wherein the total anionic concentration of said metasilicate ion plus said nitrate ion is 1,000 ppm with respect to the water and the ionic concentration of the nitrate ion is 500 ppm taken with respect to the water.

6. The pitting and general corrosion inhibitor of claim 1 wherein said water-soluble metasilicate is sodium metasilicate and said water-soluble nitrate is sodium nitrate.

7. The pitting and general corrosion inhibitor of claim 6, wherein the concentration of said sodium metasilicate is about 0.8 gram per liter of water and the concentration of said sodium nitrate is about 0.68 gram per liter of water.

8. The method of inhibiting pitting and general corrosion in a water-cooled system which includes aluminum water-cooled members which have water-carrying channels formed therein, which method comprises:

including in the cooling water a corrosion inhibitor consisting essentially of a mixture of water-soluble metasilicate and water-soluble nitrate, with the total anionic concentration of metasilicate ions plus nitrate ions being from about 750 ppm to 10,000 ppm taken with respect to the water, and controlling the concentrations of said metasilicate ions and said nitrate so that the curve of total anionic concentration of said ions versus the ionic ratio of $$\frac{(SiO_3^{-2})}{(SiO_3^{-2}) + (NO_3^{-1})}$$

falls within the cross-hatched area in the graph as shown in the sole FIGURE of the drawing.

9. The method of claim 8, wherein the total anionic concentration of said metasilicate ion plus said nitrate ion is maintained at about 1,000 ppm with respect to the water and the ionic concentration of said nitrate ion is controlled so that it is about 500 ppm with respect to the water.

10. The method of claim 8, wherein said water-soluble metasilicate and said water-soluble nitrate are introduced into said cooling water by adding to said cooling water sodium metasilicate and sodium nitrate.

11. The method of claim 10, wherein about 0.8 gram of sodium metasilicate and about 0.68 gram of sodium nitrate are added to each liter of said cooling water.

* * * * *